US009719312B2

(12) United States Patent
Vanderford et al.

(10) Patent No.: US 9,719,312 B2
(45) Date of Patent: Aug. 1, 2017

(54) ADJUSTABLE MUDLINE TUBING HANGER SUSPENSION SYSTEM

(71) Applicant: Cameron International Corporation, Houston, TX (US)

(72) Inventors: Delbert Edwin Vanderford, Cypress, TX (US); Max Van Adrichem, Houston, TX (US); Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 15 days.

(21) Appl. No.: 14/698,128

(22) Filed: Apr. 28, 2015

(65) Prior Publication Data

US 2015/0315852 A1 Nov. 5, 2015

Related U.S. Application Data

(62) Division of application No. 13/186,571, filed on Jul. 20, 2011, now Pat. No. 9,045,960.

(51) Int. Cl.

| | |
|---|---|
| ***E21B 33/043*** | (2006.01) |
| ***E21B 23/02*** | (2006.01) |
| ***E21B 19/00*** | (2006.01) |
| ***E21B 19/06*** | (2006.01) |
| ***E21B 23/00*** | (2006.01) |
| ***E21B 33/04*** | (2006.01) |

(52) U.S. Cl.

CPC ..... *E21B 19/002* (2013.01); *E21B 19/06* (2013.01); *E21B 23/00* (2013.01); *E21B 33/0422* (2013.01)

(58) Field of Classification Search

CPC ..... E21B 23/02; E21B 23/03; E21B 23/00; E21B 33/04; E21B 33/043

See application file for complete search history.

(56) References Cited

U.S. PATENT DOCUMENTS 5,002,131 A * 3/1991 Cromar ..... E21B 33/04 166/208
5,671,812 A * 9/1997 Bridges ..... E21B 33/038 166/348

* cited by examiner

*Primary Examiner* — Catherine Loikith
(74) *Attorney, Agent, or Firm* — Chamberlain Hrdlicka

(57) ABSTRACT

An adjustable mudline suspension system, including a tubing hanger having an exterior profile, a clamp having an inner profile to mate with the exterior profile of the tubing hanger, a biasing element to bias the clamp radially inward into an engaged position where the inner and exterior profiles are mated, and a piston to bias the clamp radially outward into a disengaged position where the inner and exterior profiles are not mated when hydraulically actuated. The weight of the tubing hanger is supported by the adjustable mudline suspension system when the interior profile of the clamp mates with the exterior profile of the hanger.

15 Claims, 8 Drawing Sheets

ADJUSTABLE MUDLINE TUBING HANGER SUSPENSION SYSTEM

BACKGROUND

A tension leg platform ("TLP") is a vertically moored floating structure used for offshore oil and gas production. The TLP is permanently moored by groups of tethers, called a tension leg, that eliminate virtually all vertical motion of the TLP. As a result of the minimal vertical motion of the TLP, the production wellhead may be located on deck instead of on the seafloor. The production wellhead connects to a subsea wellhead by one or more rigid risers.

The risers that connect the production wellhead to the subsea wellhead can be thousands of feet long and extremely heavy. To prevent the risers from buckling under their own weight or placing too much stress on the subsea wellhead, upward tension is applied, or the riser is lifted, to relieve a portion of the weight of the riser. The risers between the surface and the mudline and the risers in the well are supported by the surface platform. Thus, the surface wellhead must be very large and complex so that it may support the full weight of the risers.

SUMMARY OF DISCLOSED EMBODIMENTS

In accordance with various embodiments, an adjustable mudline suspension system includes a tubing hanger having an exterior profile, a clamp having an inner profile to mate with the exterior profile of the tubing hanger, a biasing element to bias the clamp radially inward into an engaged position where the inner and exterior profiles are mated, and a piston to bias the clamp radially outward into a disengaged position where the inner and exterior profiles are not mated when hydraulically actuated. The weight of the tubing hanger is supported by the adjustable mudline suspension system when the interior profile of the clamp mates with the exterior profile of the hanger.

In accordance with another embodiment, a method of installing an adjustable mudline suspension system includes adjusting a tubing hanger to achieve a desired tension on a tubing string, setting the tubing hanger with a clamp to maintain the desired tension on the tubing string, and locking the clamp to the tubing hanger. The tubing hanger has an exterior profile and the clamp has an inner profile.

In accordance with yet another embodiment, an adjustable mudline suspension system includes a mudline housing having an inner profile, a dog having an exterior profile to mate with the inner profile of the mudline housing, a biasing element to bias the dog radially inward into a disengaged position where the inner and exterior profiles are not mated, and piston to bias the dog radially outward into an engaged position where the inner and exterior profiles are mated when hydraulically actuated. The weight of the tubing hanger is supported by the adjustable mudline suspension system when the exterior profile of the dog mates with the interior profile of the mudline housing.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

Figure 1:
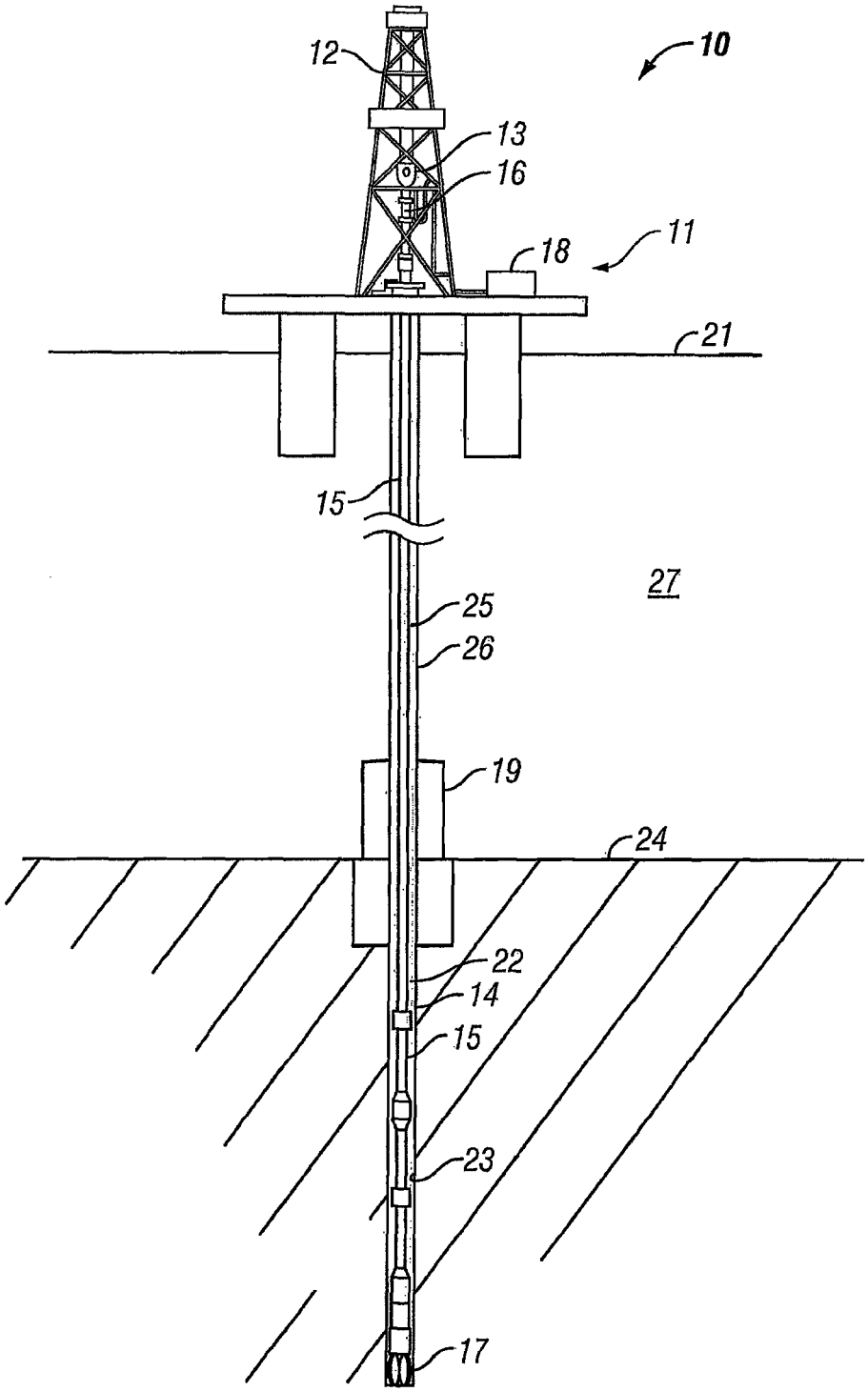
FIG. 1 shows an offshore sea-based drilling system in accordance with various embodiments.

In the drawings and description that follows, like parts are marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The invention is subject to embodiments of different forms. Some specific embodiments are described in detail and are shown in the drawings, with the understanding that the disclosure is to be considered an exemplification of the principles of the invention, and is not intended to limit the invention to the illustrated and described embodiments. The different teachings of the embodiments discussed below may be employed separately or in any suitable combination to produce desired results. The terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, a schematic view of an offshore drilling system 10 is shown. Drilling system 10 comprises an offshore drilling platform 11 equipped with a derrick 12 that supports a hoist 13. Drilling of oil and gas wells is carried out by a string of drill pipes connected together by "tool" joints 14 so as to form a drill string 15 extending subsea from platform 11. The hoist 13 suspends a kelly 16 used to lower the drill string 15. Connected to the lower end of the drill string 15 is a drill bit 17. The bit 17 is rotated by rotating the drill string 15 and/or a downhole motor (e.g., downhole mud motor). Drilling fluid, also referred to as drilling "mud", is pumped by mud recirculation equipment 18 (e.g., mud pumps, shakers, etc.) disposed on platform 11. The drilling mud is pumped at a relatively high pressure and volume through the drilling kelly 16 and down the drill string 15 to the drill bit 17. The drilling mud exits the drill bit 17 through nozzles or jets in face of the drill bit 17. The mud then returns to the platform 11 at the sea surface 21 via an annulus 22 between the drill string 15 and the borehole 23, through subsea wellhead 19 at the sea floor 24, and up an annulus 25 between the drill string 15 and a casing 26 extending through the sea 27 from the subsea wellhead 19 to the platform 11. At the sea surface 21, the drilling mud is cleaned and then recirculated by the recirculation equipment 18. The drilling mud is used to cool the drill bit 17, to carry cuttings from the base of the borehole to the platform 11, and to balance the hydrostatic pressure in the rock formations.

Figure 2A:
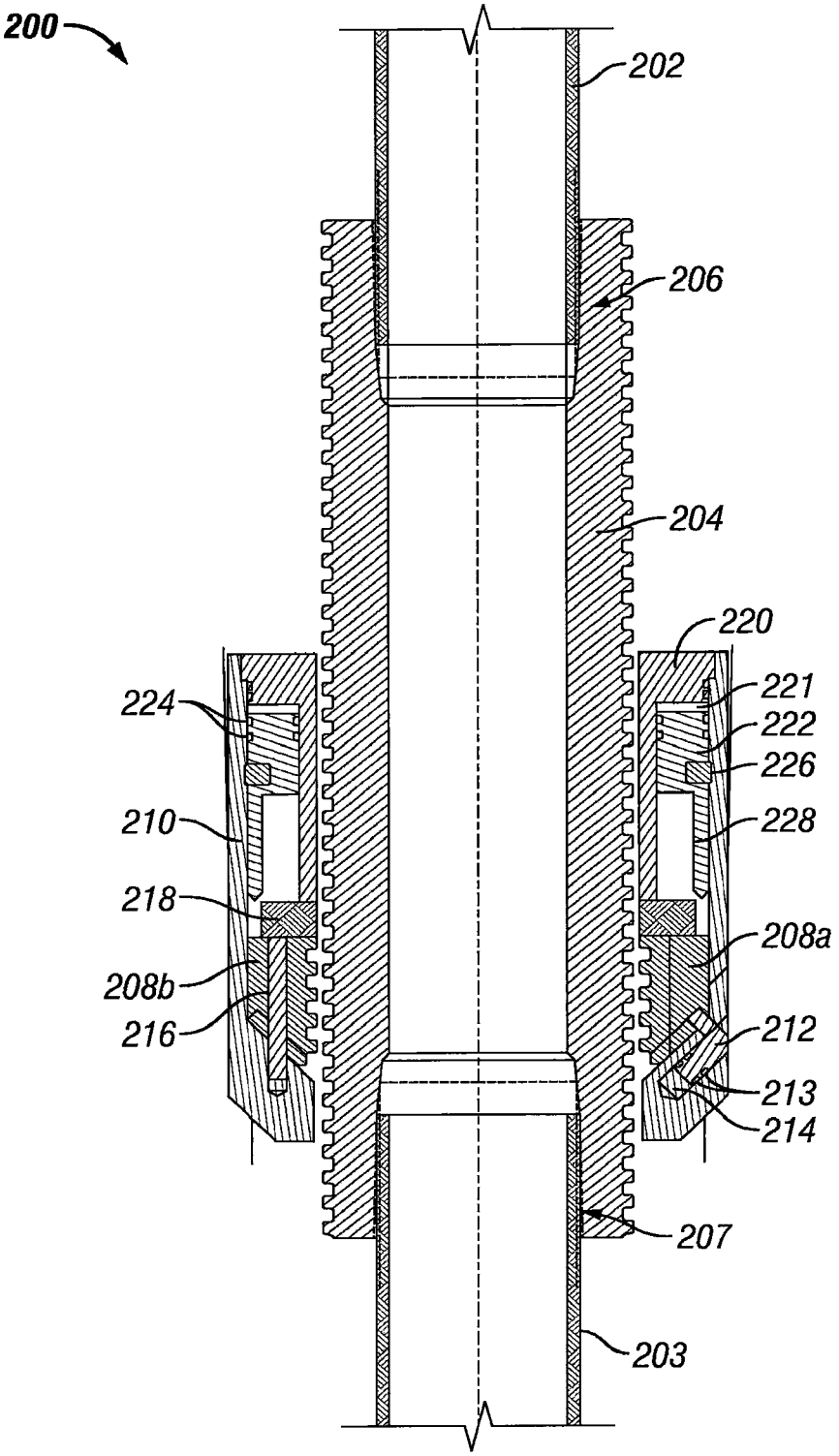
FIG. 2*a* shows an unset configuration of an adjustable mudline tubing hanger suspension system in accordance with various embodiments.

FIG. 2*a* shows an adjustable mudline tubing hanger suspension system 200 in accordance with various embodiments. A hanger 204 is located in the subsea wellhead 19 located on the sea floor. A riser 202 extends from the hanger 204 to the surface and is coupled to a production platform, such as platform 11 shown in FIG. 1. In some embodiments, premium threads or another sealing mechanism 206 provide a seal between the riser 202 and the hanger 204, which allows hydrocarbons to flow to the production platform. The bottom end of the hanger 204 is similarly coupled to a riser 203 that extends into the wellbore. In some embodiments, premium threads or another sealing mechanism 207 provide a seal between the riser 203 and the hanger 204. The hanger 204 has an exterior profile 205 comprising a plurality of teeth, which may be helical (i.e., threads) or non-helical (i.e., stacked). In accordance with various embodiments, the teeth are manufactured to resist fatigue and to withstand high loads, such as the weight of the riser 203 that extends into the wellbore. In some embodiments, the exterior profile 205 comprises a single tooth, although one skilled in the art will appreciate that the exterior profile 205 may be designed in many alternate ways to interface with another surface.

A clamp 208*a* is situated inside a mudline housing 210 that is installed in the subsea wellhead 19. The clamp 208*a* has an interior profile 209 comprising a plurality of teeth, which may be helical (i.e., threads) or non-helical (i.e., stacked). The interior profile 209 of the clamp 208*a* is configured to mate with the exterior profile 205 of the hanger 204. In FIG. 2*a*, the clamp 208*a* is shown in an unset configuration (i.e., the clamp 208*a* is not engaging the hanger 204). Similar to the teeth of the hanger 204, the teeth of the clamp 208*a* are manufactured to resist fatigue and to withstand high loads, such as the weight of the riser 203 that extends into the wellbore. A hydraulic chamber 214 houses a biasing piston 212. Hydraulic fluid may be pumped into or removed from the hydraulic chamber 214, which is isolated by o-rings 213, causing the biasing piston 212 to move laterally relative to the sloped interior surface of the housing 210. The biasing piston is coupled to the clamp 208*a* such that motion of the biasing piston 212 induces a corresponding motion of the clamp 208*a* along the sloped interior surface of the housing 210.

A clamp 208*b* is an alternate view of the clamp 208*a* to illustrate the inclusion of a spring screw 216 (i.e., clamp 208*a* also includes a spring screw but is not shown). The upper end of the spring screw 216 is coupled to a retention block 218. The spring screw 216 applies a downward spring force to the retention block 208, which in turn applies the downward spring force to the clamp 208*b*. In accordance with various embodiments, the downward spring force biases the clamp 208*b* inward as a result of the sloped interior surface of the housing 210. The mechanical biasing of the clamp 208*b* inward provides a safety mechanism in the event of a failure. That is, in some embodiments, the clamp 208*b* is biased into contact with the hanger 204 as a default to prevent slippage of the hanger 204 in the event of a failure. In some embodiments, the adjustable mudline tubing hanger suspension system 200 may comprise a single clamp 208*a* while in other embodiments, multiple clamps similar to clamp 208*a* may be positioned in the housing 210 around the circumference of the hanger 204. For example, two diametrically opposed clamps may reside inside the housing 210.

A locking mechanism includes hydraulic cylinder 220 attached to the inside of the mudline housing 210, which houses a locking piston 222 with a locking extension 228 so as to create a chamber 221 between the hydraulic cylinder 220 and the locking piston 222. The locking piston 222 comprises an outwardly-biased lockring 226 and o-rings 224 that allow hydraulic fluid to be pumped into the chamber 221, urging the locking piston 222 downward. The lockring 226 is outwardly biased and configured to mate with a recess on the inner surface of the housing 210 so that the locking piston 222 is prevented from moving downward before hydraulic fluid is pumped into the chamber 221. The locking extension 228 extends from the lower end of the locking piston 222 and is sized to prevent outward movement of the clamp 208*a* when positioned between the outer portion of the clamp 208*a* and the housing 210. In FIG. 2*a*, the locking piston 222 is shown in an unlocked configuration (i.e., the locking piston 222 is not lowered and thus the locking extension 228 is not preventing outward movement of the clamp 208*a*).

In accordance with various embodiments, with the locking mechanism disengaged, hydraulic fluid is pumped into the hydraulic chamber 214, which causes the piston 212 to urge the clamp 208*a* up the sloped inner surface of the housing 210 and out of contact with the hanger 204. After the clamp 208*a* is disengaged from the hanger 204, the position of the hanger 204 may be adjusted (e.g., by a crane on the surface) to achieve a desired amount of tension to be supported by the adjustable mudline tubing hanger suspension system 200.

Figure 2B:
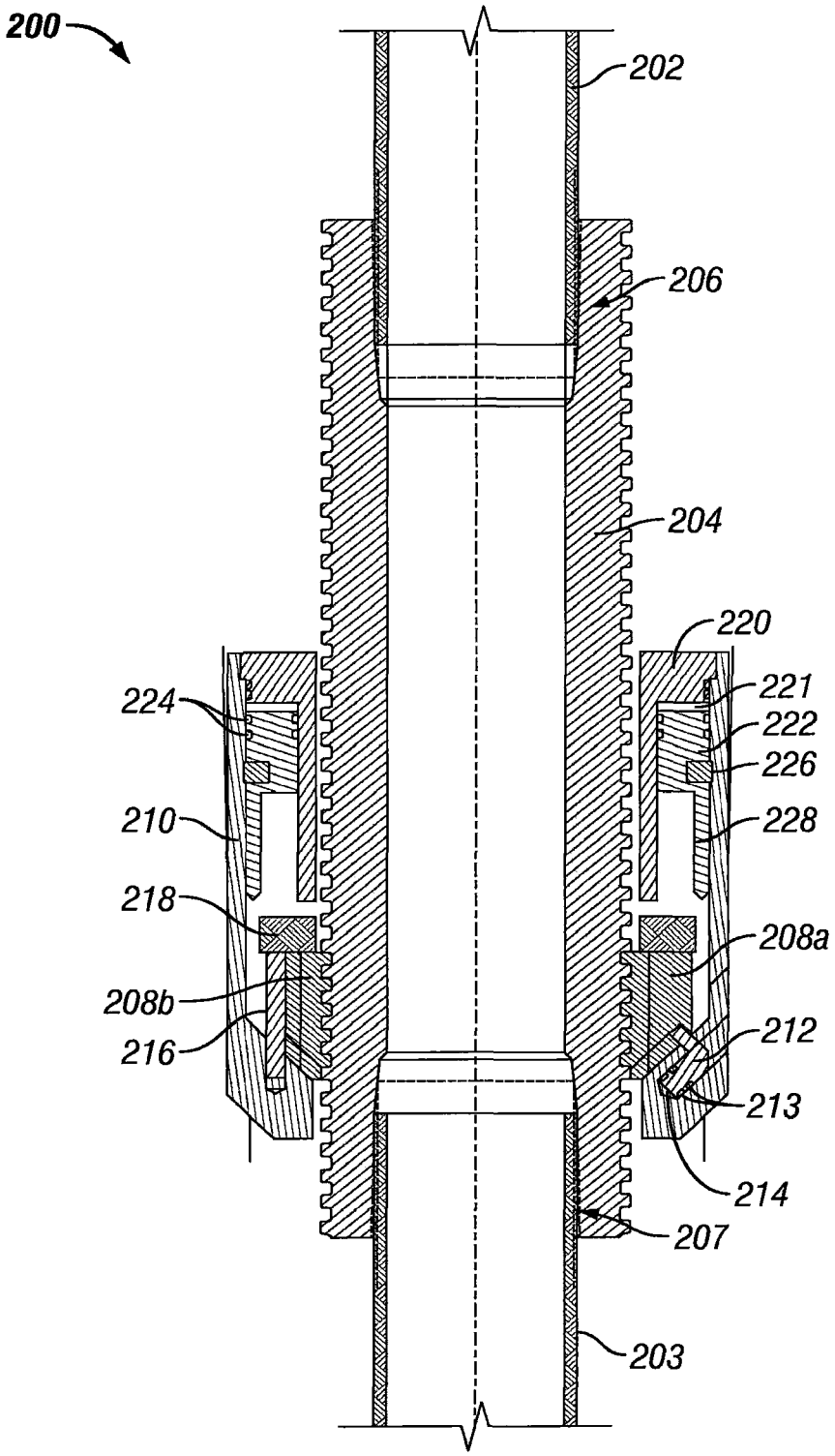
FIG. 2*b* shows a set configuration of an adjustable mudline tubing hanger suspension system in accordance with various embodiments.

FIG. 2*b* shows an adjustable mudline tubing hanger suspension system 200 in accordance with various embodiments. In FIG. 2*b*, the clamp 208*a* is shown in a set configuration (i.e., the clamp 208*a* is engaging the hanger 204). As explained above, the spring screw 216 applies a downward spring force to the retention block 208, which in turn applies the downward spring force to the clamp 208*b*. Thus, when hydraulic fluid pressure is released from the hydraulic chamber 214, the downward spring force biases the clamp 208*a* inward as a result of the sloped interior surface of the housing 210 and the teeth of the clamp 208*a* engage the teeth of the hanger 204. When the clamp 208*a* is set, the weight of the riser 203 is supported by the adjustable mudline tubing hanger suspension system 200. As a result, the production platform only supports the weight of the riser 202, allowing a reduction in size and weight of the supporting equipment on the production platform.

In some embodiments, further adjustments of the vertical position of the hanger 204 are necessary to achieve the proper tension on the riser 202. The clamp 208*a* may disengage the hanger 204 by pumping hydraulic fluid into the hydraulic chamber 214, causing the piston 212 to urge the clamp 208*a* up the sloped inner surface of the housing 210 and out of contact with the hanger 204. As explained above, the vertical position of the hanger 204 may be adjusted (e.g., by a crane on the surface) to achieve a desired amount of tension to be supported by the adjustable mudline tubing hanger suspension system 200. Hydraulic fluid pressure may then be released from the hydraulic chamber 214, causing the clamp 208*a* to engage the hanger 204.

Figure 2C:
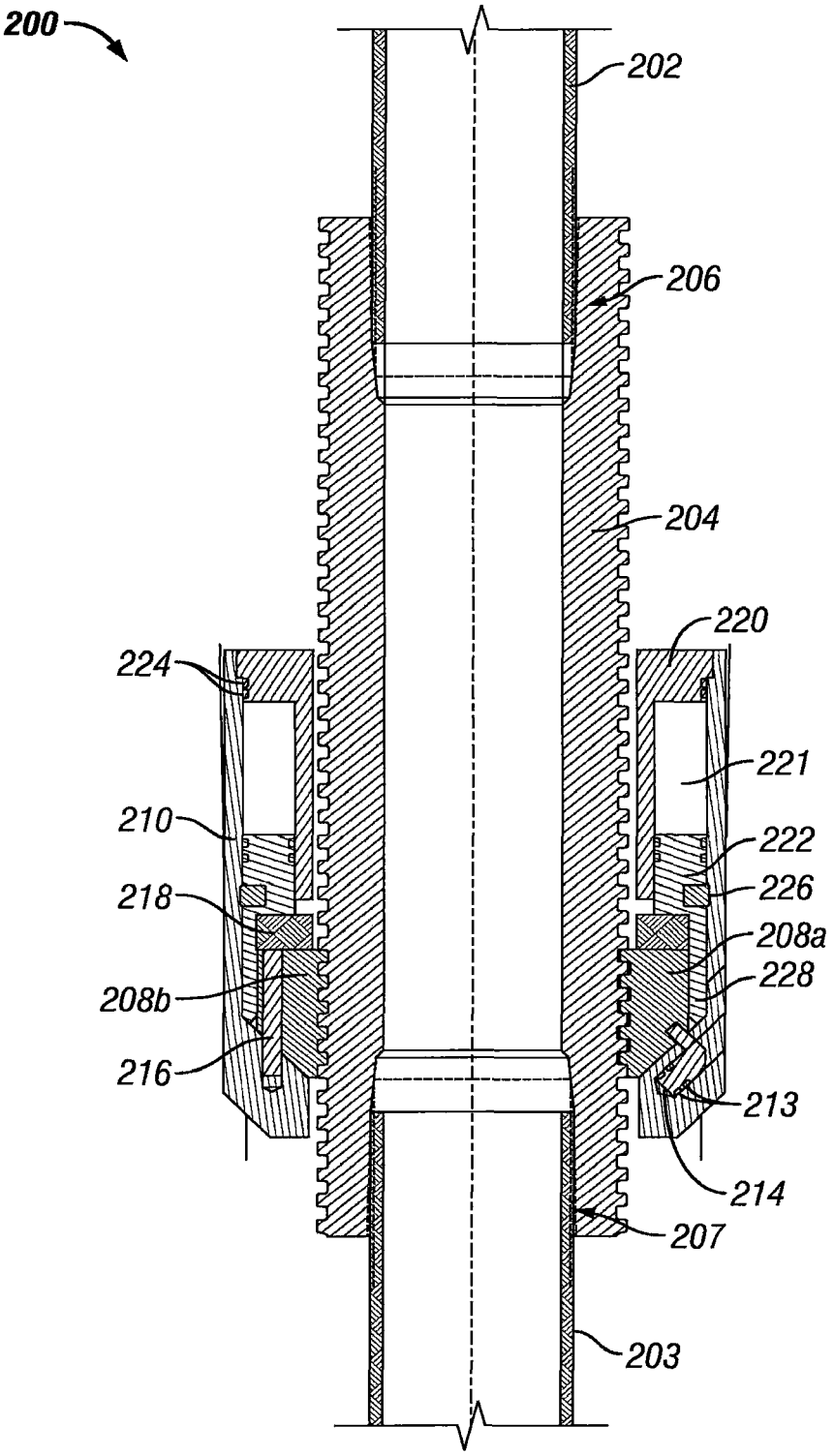
FIG. 2*c* shows a locked configuration of an adjustable mudline tubing hanger suspension system in accordance with various embodiments.

FIG. 2*c* shows an adjustable mudline tubing hanger suspension system 200 in accordance with various embodiments. In FIG. 2*c*, the clamp 208*a* is shown in a locked configuration (i.e., the clamp 208*a* is engaging the hanger 204 and the locking piston 222 is lowered to prevent outward movement of the clamp 208*a*). As explained above, the locking piston 222 is prevented from moving downward by the outwardly-biased lockring 226 that mates with a recess on the inner surface of the housing 210.

Figure 3:
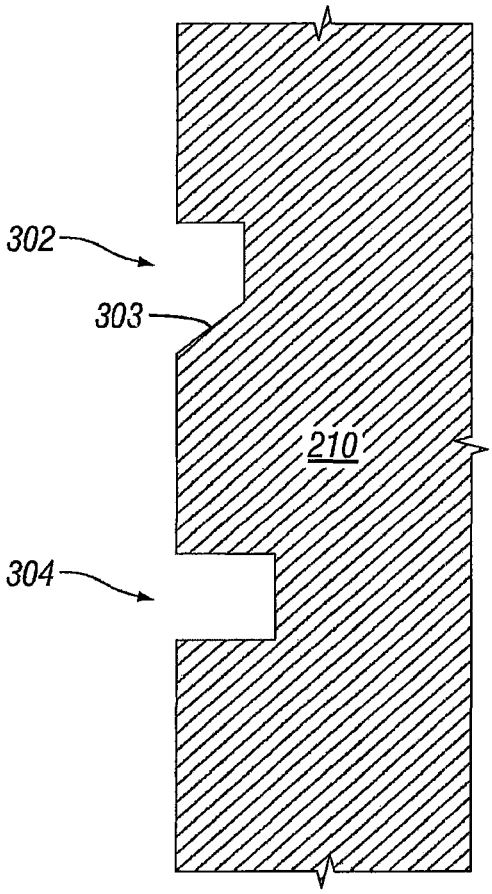
FIG. 3 shows an exploded view of an interior wall of a mudline housing in accordance with various embodiments.

Referring now to FIG. 3, an expanded view of the inner surface of the housing 210 is shown. In the unlocked position, the lockring 226 engages a recess 302, which has an angled lower edge 303. The angled lower edge 303 enables the lockring 226 to be compressed, for example in response to downward motion of the locking piston 222 caused by an increase in hydraulic pressure in the hydraulic chamber 221. Thus, when the lockring 226 engages the recess 302, downward motion of the locking piston 222 is prevented to a point. However, the lockring 226 may be compressed and urged out of the recess 302 in response to, for example, a pre-determined amount of downward pressure applied to the locking piston 222.

Still referring to FIG. 3, as the locking piston 222 is forced downward, the lockring 226 engages a recess 304, which has a lower edge that is approximately perpendicular to the inner surface of the housing 210. The recess 304 is positioned such that the lockring 226 engages the recess 304 when the locking extension 228 is positioned between the clamp 208*a* and the housing 210. In accordance with various embodiments, the lower edge of the recess 304 that is approximately perpendicular to the inner surface of the housing 210 prevents the lockring 226 from being compressed and forced out of the recess 304 by upward or downward pressure.

Referring back to FIG. 2*c*, the locking piston 222 is shown after being urged downward by an increase in hydraulic pressure in the hydraulic chamber 221. The downward movement causes the lockring 226 to engage a recess, such as the recess 304 shown in FIG. 3, when the locking extension 228 is positioned between the clamp 208*a* and the housing 210. In accordance with various embodiments, the locking extension 228 prevents outward movement of the clamp 208*a*, effectively locking the clamp 208*a* into contact with the hanger 204. In some embodiments, the lockring 226 is prevented from being compressed and forced out of the recess 304, and thus accidental movement of the clamp 208*a* is prevented.

When the adjustable mudline tubing hanger suspension system 200 is in a locked and set configuration, the weight of the riser 203 is supported at the mudline rather than at the surface. This reduction in the amount of weight that must be bore by the surface vessel or platform enables a reduction in size and complexity of the support systems installed on the platform.

Figure 4A:
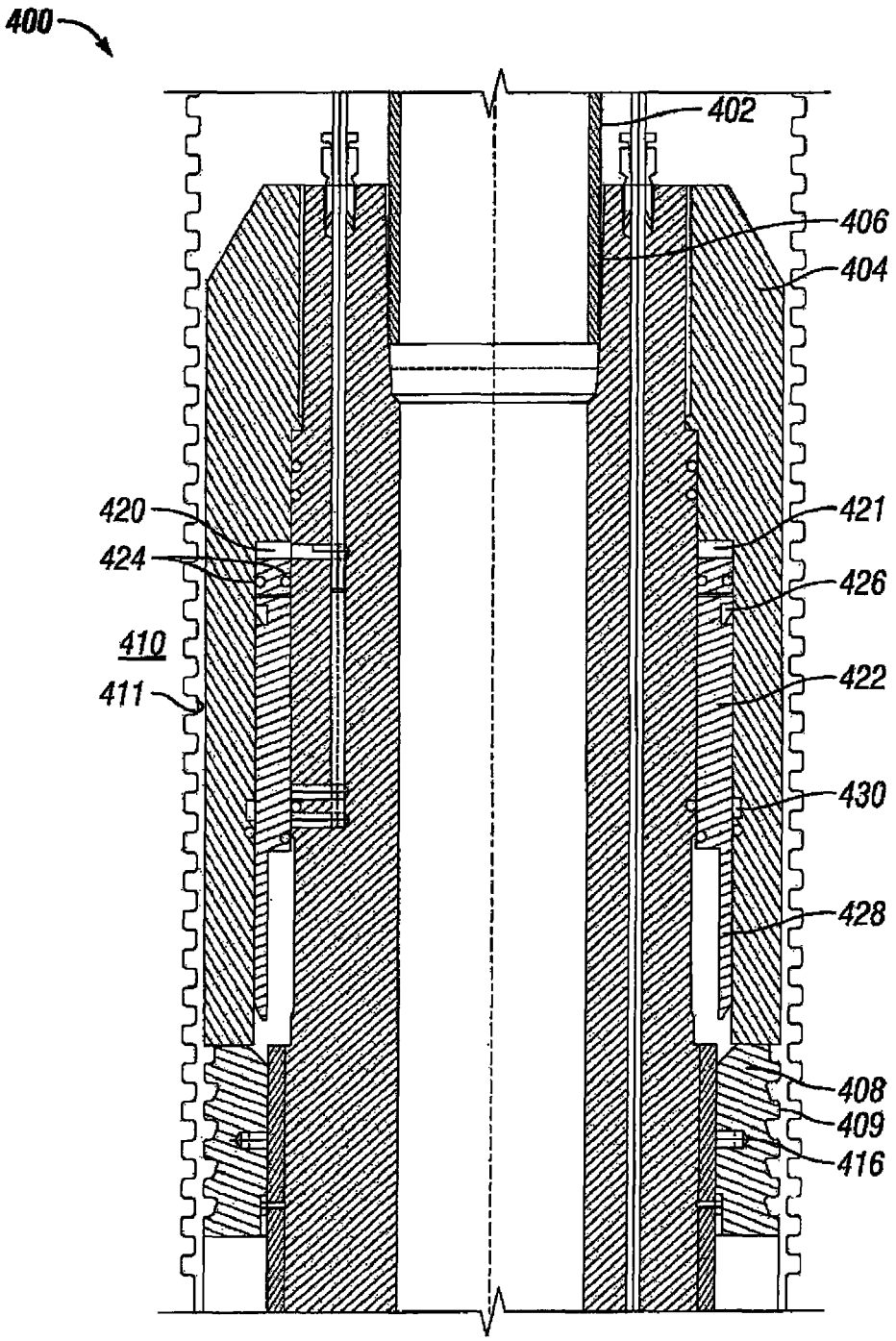
FIG. 4*a* shows an unset configuration of an alternate adjustable mudline tubing hanger suspension system in accordance with various embodiments.

FIG. 4*a* shows an alternate embodiment of an adjustable mudline tubing hanger suspension system 400. In this embodiment, rather than clamps moving radially inward to engage the outer profile of a hanger coupled to a riser, a portion of a hanger body coupled to the riser is urged radially outward to engage the inner profile of a portion of the subsea wellhead. In accordance with various embodiments, a hanger body 404 is positioned in the subsea wellhead 19 located on the sea floor. A riser 402 is coupled to the hanger body 404 and extends to the surface and is coupled to a production platform, such as platform 11 shown in FIG. 1. In some embodiments, premium threads or another sealing mechanism 406 provide a seal between the riser 402 and the hanger body 404, which allows hydrocarbons to flow to the production platform. The bottom end of the hanger body 404 is similarly coupled to a riser (not shown) that extends into the wellbore.

The hanger body 404 comprises a dog 408 that has an exterior profile 409 comprising a plurality of teeth, which may be helical (i.e., threads) or non-helical (i.e., stacked). In accordance with various embodiments, the teeth are manufactured to resist fatigue and to withstand high loads, such as the weight of the riser that extends into the wellbore. In some embodiments, the exterior profile 409 comprises a single tooth, although one skilled in the art will appreciate that the exterior profile 409 may be designed in many alternate ways to interface with another surface.

A mudline housing 410 installed in the subsea wellhead 19 comprises an interior profile 411. The interior profile 411 comprises a plurality of teeth, which may be helical (i.e., threads) or non-helical (i.e., stacked). The interior profile 411 of the mudline housing 410 is configured to mate with the exterior profile 409 of the dog 408. In FIG. 4*a*, the dog 408 is shown in an unset configuration (i.e., the dog 408 is not engaging the mudline housing 410). Similar to the teeth of the dog 408, the teeth of the mudline housing 410 are manufactured to resist fatigue and to withstand high loads, such as the weight of the riser that extends into the wellbore. In alternate embodiments, the interior profile 411 may be the interior profile of another hanger situated in the mudline housing 410, or other similar structure The dog 408 comprises a spring screw 416 that is coupled to the hanger body 404. The spring screw applies an inward spring force to the dog 408, which biases the dog 408 inward and out of contact with the mudline housing 410. In some embodiments, the adjustable mudline tubing hanger suspension system 400 may comprise a single dog 408 while in other embodiments, multiple dogs similar to dog 408 may be positioned around the circumference of the hanger body 404. For example, two diametrically opposed clamps may reside inside the hanger body 404.

A locking mechanism includes hydraulic cylinder 220, which houses a locking piston 422 with a locking extension 428 so as to create a chamber 421 between the hydraulic cylinder 420 and the locking piston 422. The locking piston 422 comprises an outwardly-biased lockring 426 and o-rings 424 that allow hydraulic fluid to be pumped into the chamber 421, urging the locking piston 422 downward. The locking extension 428 extends from the lower end of the locking piston 422 and is sized to urge the dog 408 inward and prevent outward movement of the dog 408 when positioned between the dog 408 and the hanger body 404.

In FIG. 4*a*, the locking piston 422 is shown in an unlocked configuration (i.e., the locking piston 422 is not lowered and thus the locking extension 428 is not urging the dog 408 inward and preventing outward movement of the dog 408). The locking piston 422 may be held in the unlocked configuration by, for example, a shear pin coupling the locking piston 422 to the hanger body 404. When the dog 408 is disengaged from the mudline housing 410, the position of the hanger body 404 relative to the mudline housing 410 may be adjusted (e.g., by a crane on the surface) to achieve a desired amount of tension to be supported by the adjustable mudline tubing hanger suspension system 400.

Figure 4B:
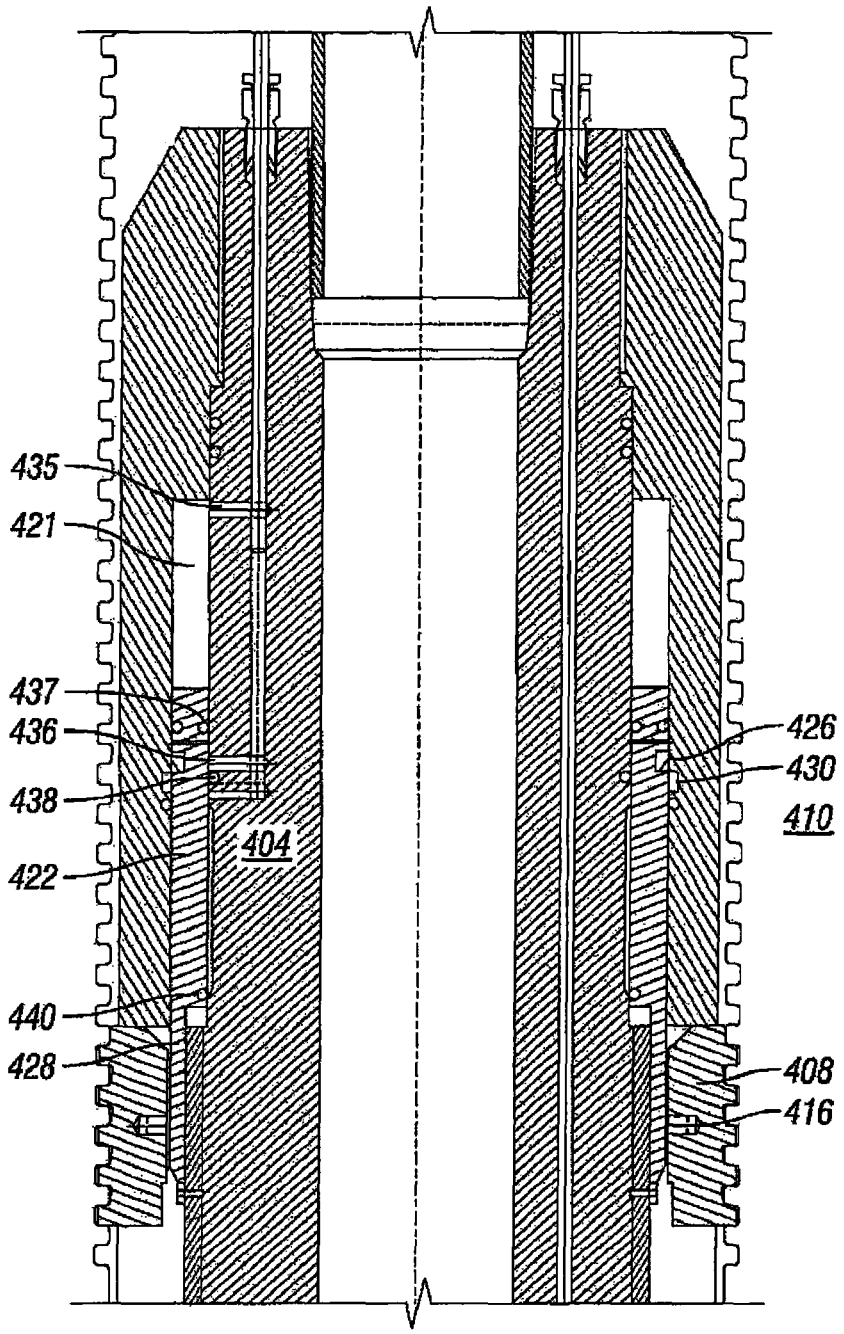
FIG. 4*b* shows a set configuration of an alternate adjustable mudline tubing hanger suspension system in accordance with various embodiments.

FIG. 4*b* shows an adjustable mudline tubing hanger suspension system 400 with the dog 408 in a set configuration (i.e., the dog 408 is engaging the mudline housing 410). In accordance with various embodiments, hydraulic fluid is pumped into the hydraulic chamber 421 through hydraulic port 435. This causes the locking piston 422 to move downward, urging the dog 408 outward and into contact with the mudline housing 410. When the dog 408 is set, the weight of the riser below the hanger body 404 is supported by the adjustable mudline tubing hanger suspension system 400. As a result, the production platform only supports the weight of the riser 402 above the hanger body 404, allowing a reduction in size and weight of the supporting equipment on the production platform.

In some embodiments, further adjustments of the vertical position of the hanger body 404 are necessary to achieve the proper tension on the riser 402. In the set configuration, the shear pins (not shown) prevent the locking piston 422 from moving far enough downward for the lockring 426 to engage a recess 430 in the hanger body 404. Thus, in the set configuration, the locking piston 422 may be urged upward. The locking piston 422 is urged upward by pumping hydraulic fluid through hydraulic port 436. An o-ring 438 in the hanger body 404 and an o-ring 437 in the locking piston 422 form a hydraulic pocket (not numbered) that expands in response to increased hydraulic pressure, forcing the locking piston 422 upward relative to the hanger body 404. In the set configuration, an inner o-ring 440 of the locking piston does not engage a surface of the hanger body 404, so hydraulic fluid flows around the o-ring 440 and out of the hanger body 404 When the locking extension 428 is no longer between the dog 408 and the hanger body 404, the spring screw 416 causes the dog 408 to disengage the mudline housing 410.

As explained above, the vertical position of the hanger body 404 may be adjusted (e.g., by a crane on the surface) to achieve a desired amount of tension to be supported by the adjustable mudline tubing hanger suspension system 400. Hydraulic fluid pressure may then be increased in the hydraulic chamber 421, causing the locking piston 422 to move downward and the dog 408 to engage the mudline housing 410.

Figure 4C:
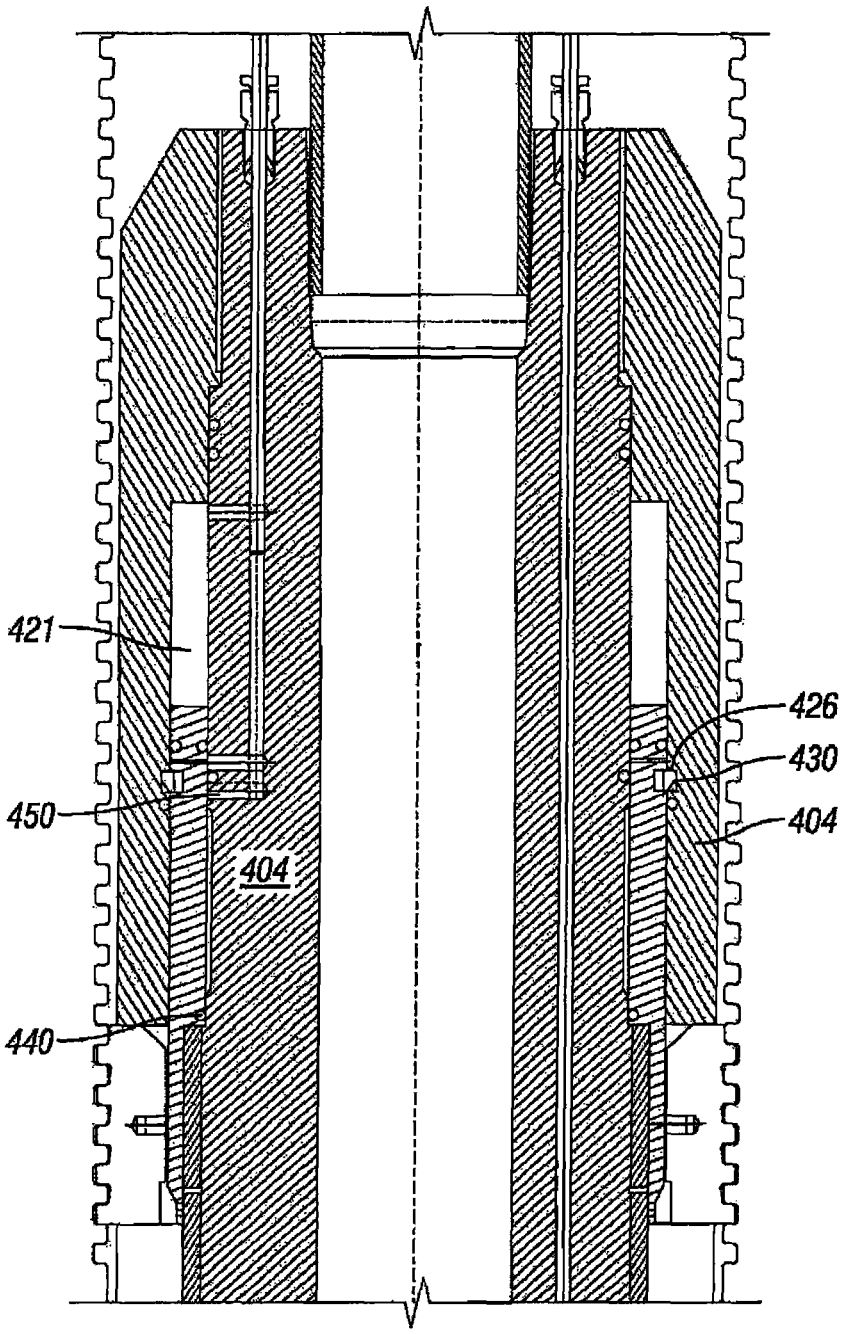
FIG. 4*c* shows a locked configuration of an alternate adjustable mudline tubing hanger suspension system in accordance with various embodiments.

FIG. 4*c* shows an adjustable mudline tubing hanger suspension system 400 with the dog 408 in a locked configuration (i.e., the dog 408 is engaging the mudline housing 410 and the locking piston 422 is lowered to prevent outward movement of the dog 408). When the hanger body 404 is in a desired vertical position, additional pressure is applied to the chamber 421 causing the shear pins to shear so that the locking piston 422 moves further downward. As a result, the outwardly-biased lockring 426 engages the recess 430, preventing further movement of the locking piston 422. In the locked configuration, the o-ring 440 engages the hanger body 404, which allows pressure to be applied via a test port 450 to determine whether the locking piston 422 is fully locked in place. The position of the o-ring 440 is such that engagement of the hanger body 404 only occurs when the lockring 426 engages the recess 430. Thus, a build-up of pressure is only possible when the dog 408 securely engages the mudline housing 410 and if no build-up is observed, a user knows that the hanger body 404 is not locked to the mudline housing 410.

In accordance with various embodiments, the locking extension 428 prevents outward movement of the dog 408, effectively locking the dog 408 into contact with the mudline housing 410. In some embodiments, the lockring 426 is prevented from being compressed and forced out of the recess 430, and thus accidental movement of the dog 408 is prevented.

When the adjustable mudline tubing hanger suspension system 400 is in a locked and set configuration, the weight of the riser below the hanger body 404 is supported at the mudline rather than at the surface. This reduction in the amount of weight that must be bore by the surface vessel or platform enables a reduction in size and complexity of the support systems installed on the platform.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. An adjustable mudline suspension system, comprising:
- a mudline housing comprising an inner profile;
- a dog of a tubing hanger comprising an exterior profile configured to mate with the inner profile of the mudline housing;
- a biasing element configured to bias the dog radially inward into a disengaged position where the inner and exterior profiles are not mated; and
- a hydraulically actuated piston configured to bias the dog radially outward into an engaged position where the inner and exterior profiles are mated;
- wherein the tubing hanger is configured to be supported by the mudline housing when the exterior profile of the dog is mated with the interior profile of the mudline housing.

2. The adjustable mudline suspension system of claim 1, wherein the inner profile of the mudline housing comprises a plurality of stacked teeth.

3. The adjustable mudline suspension system of claim 1, wherein the biasing element comprises a spring screw that biases the dog radially inward.

4. The adjustable mudline suspension system of claim 1, further comprising a lockring configured to prevent movement of the piston.

5. The adjustable mudline suspension system of claim 4, wherein the lockring is radially biased outward and configured to engage a radial recess in the tubing hanger.

6. The adjustable mudline suspension system of claim 4, wherein the lockring is configured to prevent the dog from moving out of contact with the mudline housing.

7. A method of installing an adjustable mudline suspension system, comprising:
- adjusting a tubing hanger to achieve a desired tension on a tubing string;
- setting a dog of the tubing hanger within an inner profile of a mudline housing to support and maintain the desired tension on the tubing string through the tubing hanger; and
- locking the dog to the mudline housing to prevent movement of the tubing hanger with respect to the mudline housing.

8. The method of claim 7, wherein the setting further comprises:
- applying a mechanical biasing force to the dog to bias the dog inward toward the tubing hanger into a disengaged position where the inner and exterior profiles are not mated; and
- applying pressure from a hydraulic chamber to move the dog into an engaged position where the inner and exterior profiles are mated.

9. The method of claim 8, wherein the applying pressure comprises applying pressure to a piston to engage the dog and move the dog radially outward into the engaged position.

10. The method of claim 7, wherein the locking further comprises moving a lockring into a radial recess in the tubing hanger.

11. The method of claim 10, wherein the lockring is radially biased outward.

12. The method of claim 7, wherein the adjusting the tubing hanger comprises raising or lowering the tubing hanger with respect to the mudline housing.

13. An adjustable mudline suspension system, comprising:

a mudline housing comprising an inner profile;

a dog comprising an exterior profile configured to mate with the inner profile of the mudline housing;

a piston configured to bias the dog radially outward into an engaged position where the inner and exterior profiles are mated; and a biasing element configured to apply a biasing force to the dog to bias the dog radially inward into a disengaged position where the inner and exterior profiles are disengaged.

14. The adjustable mudline suspension system of claim 13, wherein the mudline housing is configured to support the weight of a tubing hanger when the exterior profile of the dog mates with the inner profile of the mudline housing.

15. The adjustable mudline suspension system of claim 13, wherein the piston is hydraulically actuated.

* * * * *